United States Patent [19]

Fegley et al.

[11] 4,024,830

[45] * May 24, 1977

[54] ANTI-BURGLAR SOUND EMITTING DEVICE

[76] Inventors: Charles R. Fegley, 1606 Frush Valley Road, Laureldale, Pa. 19605; Werner F. Esseluhn, 12 Larchwood Road, Wyomissing, Pa. 19610

[ * ] Notice: The portion of the term of this patent subsequent to May 11, 1993, has been disclaimed.

[22] Filed: Dec. 15, 1975

[21] Appl. No.: 640,727

[52] U.S. Cl. ..... 116/86; 116/114 F; 116/142 FP

[51] Int. Cl.[2] ..... G08B 13/08

[58] Field of Search ..... 116/75, 142 FP, 86, 116/85, 67 R, 6, 114 F

[56] References Cited

UNITED STATES PATENTS

| | | | |
|---|---|---|---|
| 1,563,176 | 11/1925 | Eimer | 116/114 F |
| 2,541,770 | 2/1951 | Lawrence | 116/75 |
| 2,570,438 | 10/1951 | Flagge | 116/81 |
| 2,626,586 | 1/1953 | Mendes | 116/67 R |
| 3,000,344 | 9/1961 | Ferrel | 116/137 R |
| 3,670,690 | 6/1972 | Swanson | 116/142 FP |
| 3,804,053 | 4/1974 | Gray | 116/86 |
| 3,957,012 | 5/1976 | Fegley | 116/6 |

*Primary Examiner*—S. Clement Swisher
*Assistant Examiner*—Denis E. Corr

[57] ABSTRACT

An anti-burglar sound emitting device is described in which a pressurized fluid is discharged to audibly oscillate a diaphragm to create a warning signal when an intruder opens a window or a door to enter an area unauthorized to the intruder. The anti-burglary device employs a spring biased actuating member for discharging a pressurized container wherein the fluid is discharged through a passageway and diaphragm valving structure. A mechanical trigger for releasably retaining the actuating member in a cocked position and for releasing the actuating member which moves the slideably mounted pressurized container to cause sound is described.

13 Claims, 18 Drawing Figures

ANTI-BURGLAR SOUND EMITTING DEVICE

BACKGROUND OF THE INVENTION

The invention relates generally to an anti-burglary device and more particularly to a device which discharges a fluid from a pressurized container through a sound emitting diaphragm valve, thereby providing an audible alarm upon its actuation by an unauthorized person. All persons in the protected area are warned and the intruder is forced to evacuate the area. Its application is possible anywhere mechanical actuation to produce an audible alarm is either desired or required.

Fluid, generally gaseous, operated audible alarms or warning devices have been known in the art for many years. One type is the conventional whistle which generally requires an external pressurized fluid source as pressurized steam or air. Other types are air operated diaphragm horns such as found on vehicles, particularly trucks, requiring either a vacuum or pressure source. There is also known in the art, fluid operated diaphragm horns using aerosol type pressurized fluid containers as an operating source but all of these are manually operated requiring both the full attention and muscular forces of the operating person for actuation.

Thus what is needed is an anti-burglar sound emitting device which can be fired by a relatively small amount of mechanical force even though the device employs a relatively heavy spring for actuation. An actuating member forces the pressurized fluid container against an entry section of a fluid passageway with sufficient force to release the fluid through the fluid passageway to the sound emitting diaphragm to cause sound when the device is triggered, but the device is also positively secured against accidental release until triggered. A motion caused by an unauthorized movement of an object such as a door, window, etc. will trigger the device and release sufficient fluid to emit sound from the device for a sufficient period of time to provoke action in response to the sound emitted.

SUMMARY OF THE INVENTION

The principal object of the present invention is to provide an anti-burglary device of the sound emitting type which may be triggered directly by a small amount of force, either applied or removed, and yet is positively secured against accidental release.

A further object of the invention is to provide a device of the sound emitting type which is readily triggered by a cord connecting the device triggering means to a window, door or other objects which might be moved by an intruder, unauthorized person or other means.

A further object of the invention is to provide a device of the sound emitting type for anti-burglary and other applications having means for resetting the triggering element and actuating member and for reloading the device after it has been triggered.

According to the principal aspect of the present invention, there is provided an improved means for releasably retaining a spring biased actuating member. The spring biased actuating member causes the slidably mounted pressurized container to be urged toward the entry section of the fluid passageway when the device is triggered. The fluid passageway leads to a diaphragm cavity. By mounting the device such that the trigger element is in cooperation with a window, door or other object which might be moved by an unauthorized person or other means in the area from which it is desired to restrict those persons. The trigger element releasably retains the slideably mounted, spring biased actuating member in engagement, thereby retaining the actuating member in its cocked position and requiring a positive action for release. When the window, door or other object associated with the device is moved by an unauthorized person, the trigger element moves from engagement thereby releasing the actuating member. The actuating member urges the pressurized container toward the entry section of the passageway by the force of the spring associated with the actuating member and causes the container to discharge its fluid through the passageway and through the sound emitting diaphragm valve. Oscillations of the diaphragm caused by repeated buildup and sudden release of fluid in the fluid expanding diaphragm cavity create the loud emission of audible sound.

Since the trigger element is movably mounted having mechanical advantage; a relatively small amount of force is required to move the trigger element from engagement with the actuating member even though a relatively strong spring is employed. The spring biased actuating member, when released, forces the container into the entry section of the passageway, thereby causing fluid discharge through the passageway and diaphragm valve. The resistance to movement of the trigger due to its mounting is sufficiently low so as not to be noticeable. Nevertheless, the trigger element serves to retain the actuating member safely in its cocked position preventing accidental release.

The anti-burglary sound emitting device of the fluid operated type of the present invention may be utilized in homes, factories, farms, offices and other buildings by mounting the device in cooperation with doors, windows, machinery, appliances, etc. The device may also be used as a signaling device for beyond limit movements of equipment, equipment functions, etc. The device may be further utilized to signal or warn inhabitants, of an area to unauthorized entries to the area protected by the device.

Once triggered, the device cannot be turned off by anyone and the entire amount of pressurized fluid is discharged whereupon the sound emissions diminish and cease. By further using a fluid which is also a dispersable irritant such as tear-gas the device can also serve to provoke immediate evacuation of the protected area.

Other objects, aspects and advantages of the invention will become apparent from the following description taken in connection with the accompanying drawings.

BRIEF DESCRIPTIONS OF THE DRAWINGS

Figure 2:
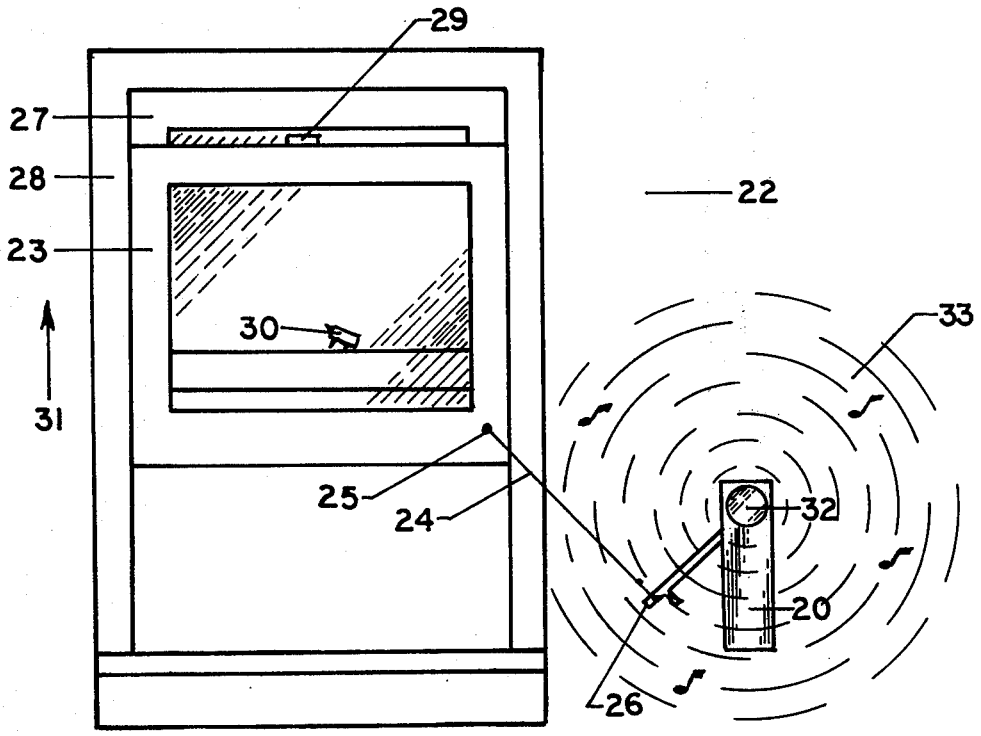
FIG. 2 is an elevational view similar to FIG. 1 but showing the window open, the cord having triggered the device which is emitting sound.
Figure 5:
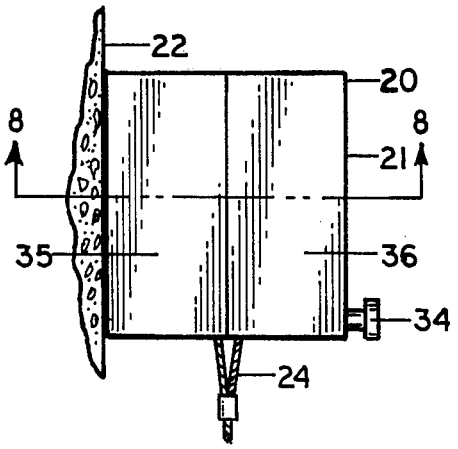
FIG. 5 is a top elevational view of the device showing the triggering cord and safety pin.
Figure 3:
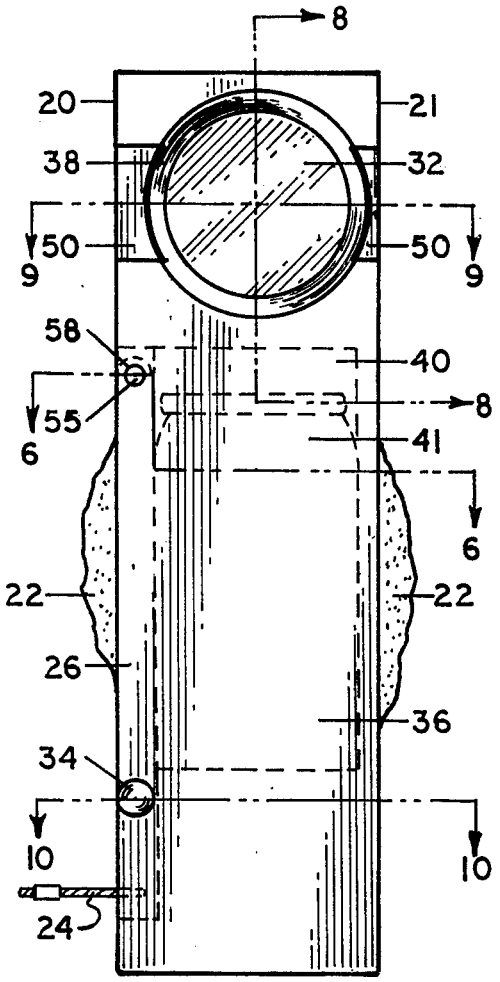
FIG. 3 is a front elevational view of the anti-burglary sound emitting device, showing the sound emitting device, the sound emitting diaphragm and safety pin.
Figure 9:
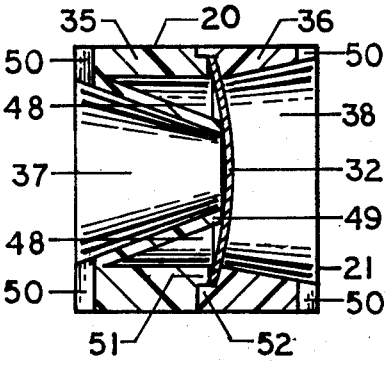
FIG. 9 is a horizontal sectional view taken along line 9—9 of FIG. 3.
Figure 8:
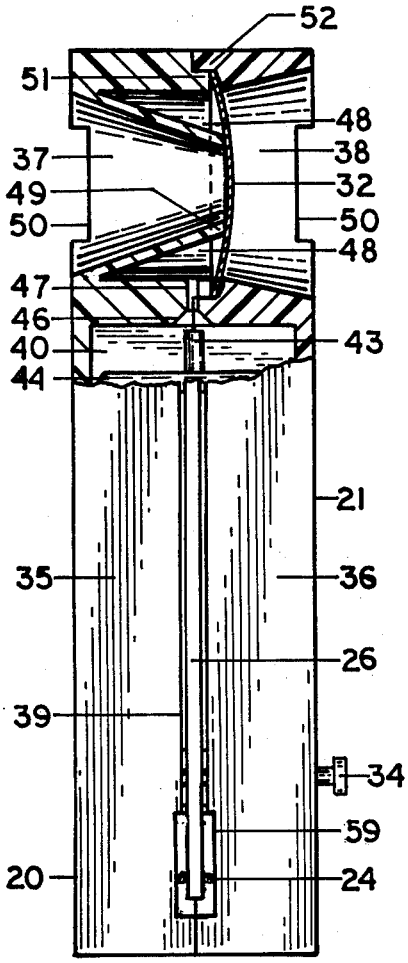
FIG. 8 is a partial vertical sectional view taken along lines 8—8 of FIGS. 3 and 5.
Figure 12:
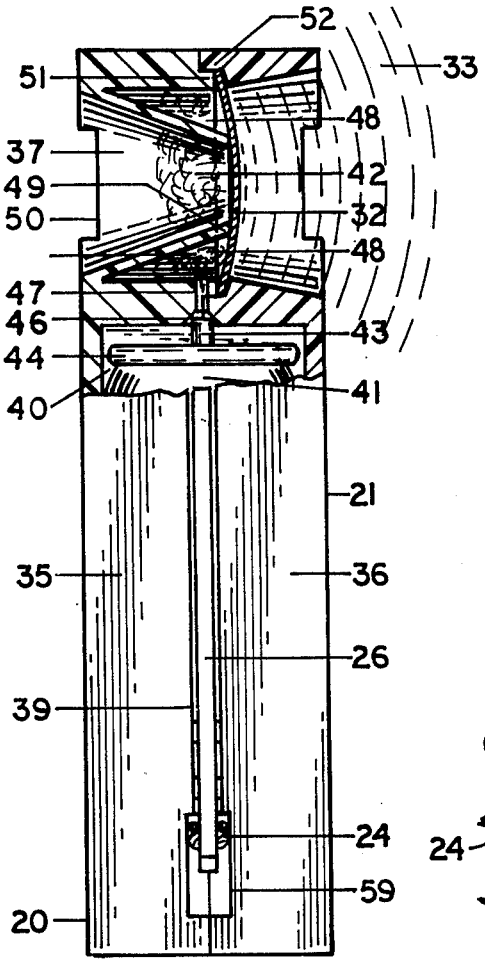
Figure 11:
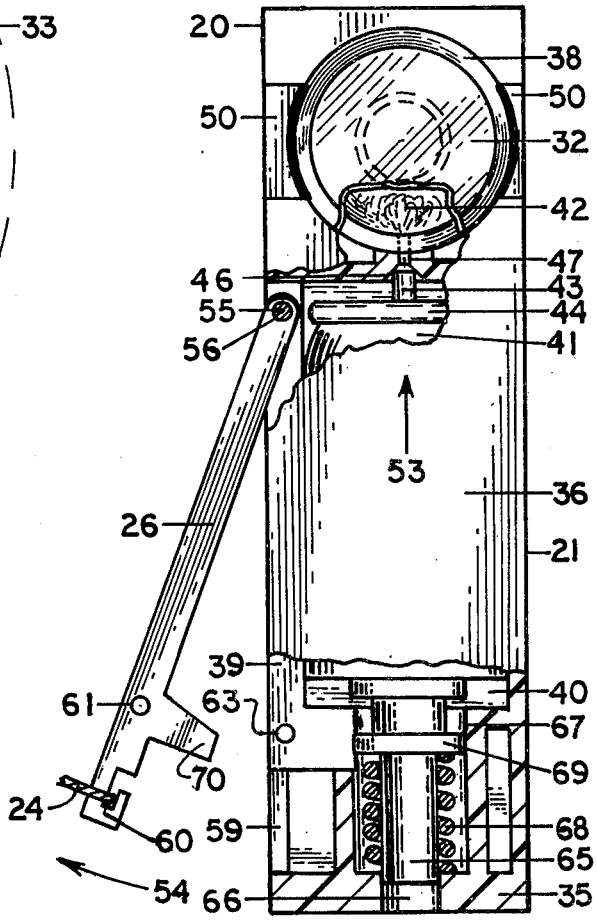
FIG. 11 is a partial vertical sectional view along line 7—7 of FIG. 4 similar to FIG. 7 except showing the device in the triggered condition of FIG. 2.

FIG. 12 is a partial vertical sectional view along lines 8—8 of FIGS. 3 and 5 similar to FIG. 8 except showing the device in the triggered condition of FIGS. 2 and 11.

Figure 4:
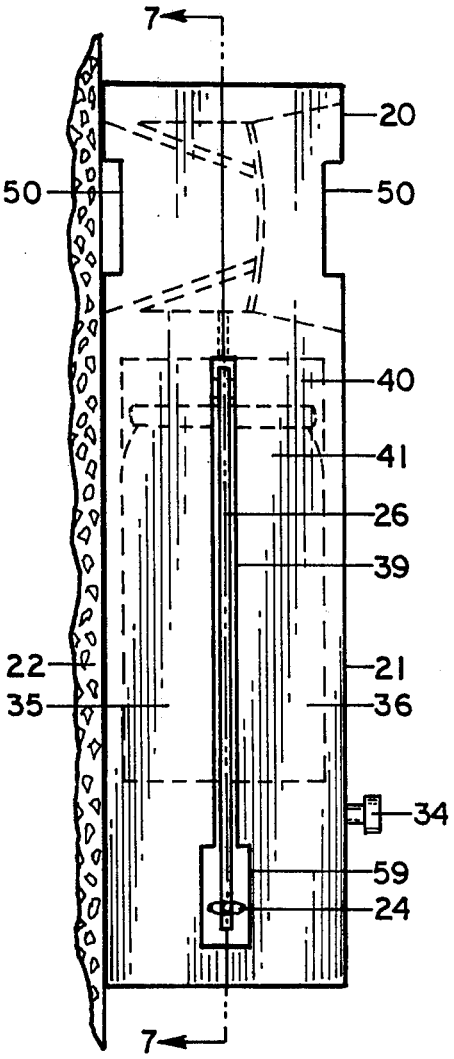
FIG. 4 is a side elevational view of the device showing the triggering element, safety pin and fluid and sound escape ports.
Figure 13:
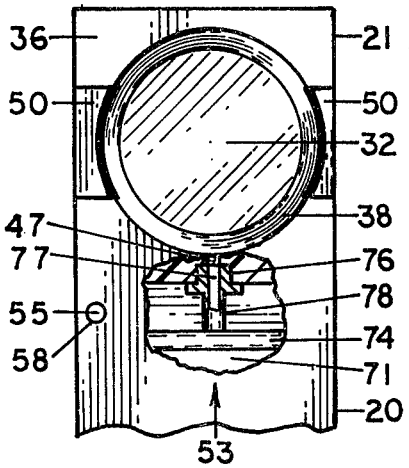

FIG. 13 is a partial vertical sectional view along line 7—7 of FIG. 4 except showing a second embodiment of the device.

Figure 14:
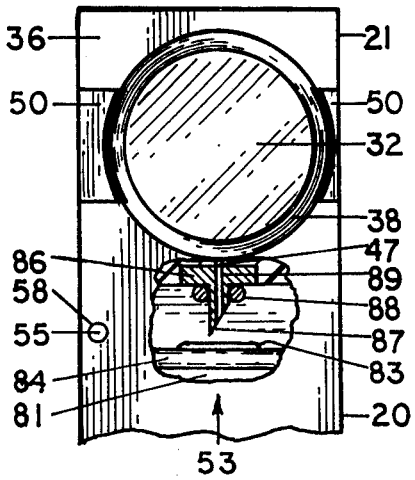

FIG. 14 is a partial vertical sectional view along line 7—7 of FIG. 4 except showing a third embodiment of the device.

Figure 15:
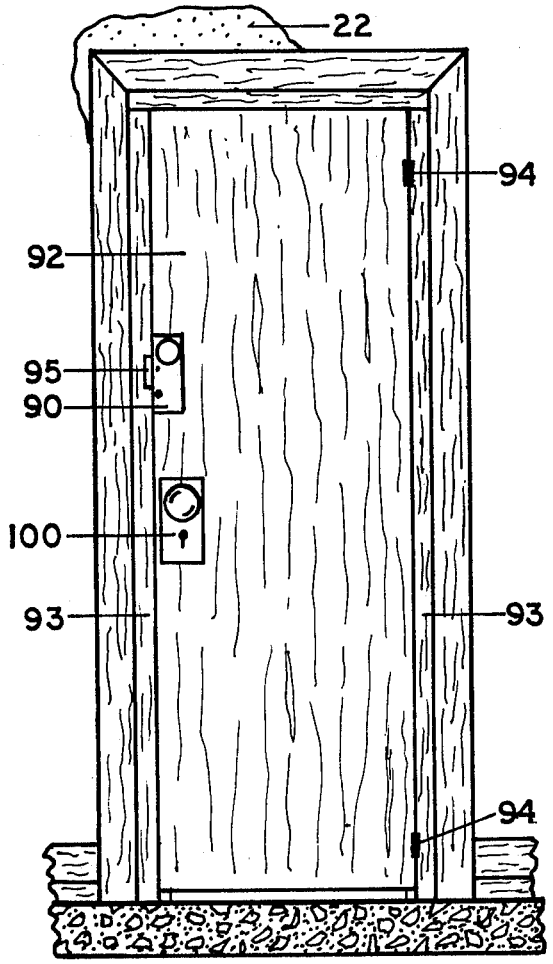

FIG. 15 is an elevational view of a wall, door and door frame showing the mounting of a fourth embodiment of the device.

Figure 16:
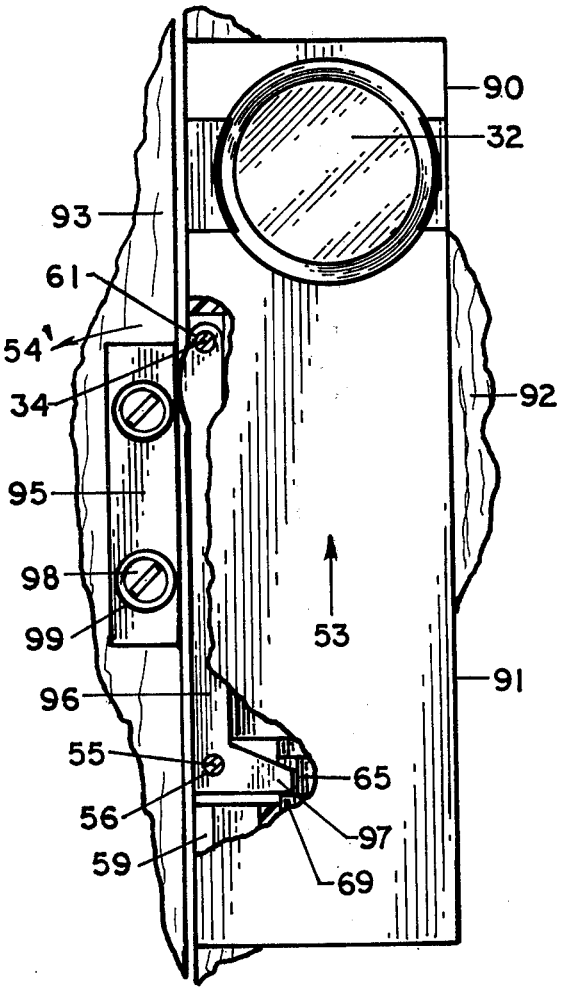

FIG. 16 is a partial vertical sectional view taken along line 7—7 of FIG. 4 except showing the fourth embodiment of the device.

Figure 17:
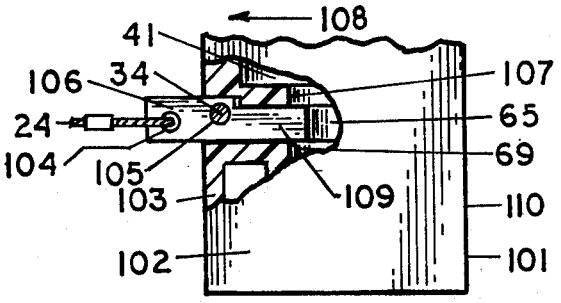

FIG. 17 is a partial sectional view taken along line 7—7 of FIG. 4 except showing a fifth embodiment of the device.

Figure 18:
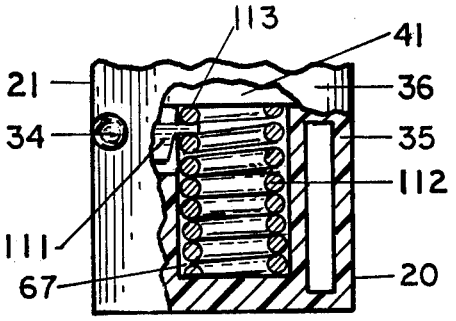

FIG. 18 is a partial sectional view taken along line 7—7 of FIG. 4 except showing a sixth embodiment of the device.

DESCRIPTION OF THE PREFERRED EMBODIMENTS

Figure 1:
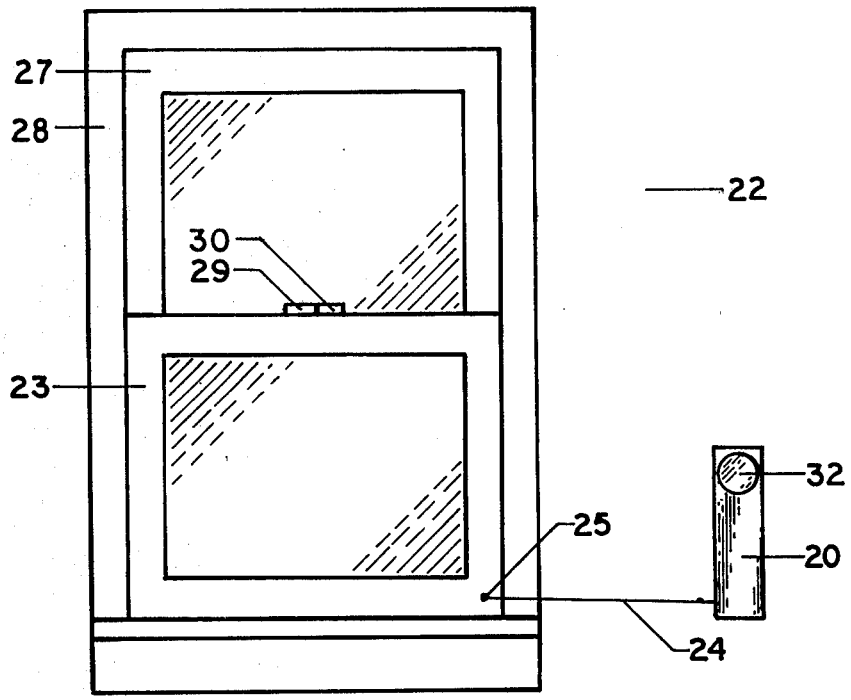
FIG. 1 is an elevational view of a wall having one embodiment of the anti-burglary sound emitting device of the present invention secured to a wall and mechanically connected with a cord to a window.

Referring now to the drawings in detail, wherein like reference characters designate like parts throughout the views, there is shown in FIGS. 1–12 one form of the anti-burglary sound emitting device, called device hereafter, of the fluid operated type according to the present invention, generally designated 20. The device 20 is secured to a wall 22 and connected by means of a cord 24 to a fastener 25 on window sash 23 of window frame 28 mounted in the wall 22 as shown in FIG. 1 so that upon opening of the sash 23 by a burglar or other intruder the device will be triggered as shown in FIG. 2. The device 20 whose front, left side and top are shown in FIGS. 3, 4 and 5 comprises of an aerosol type pressurized fluid container 41 slideably mounted in a body member 21 shown for convenience as being comprised of a front body half 36 and a back body half 35. The body halves 35 and 36 when assembled provide three flat sides — the back, right side and front — for mounting the device 1 to the wall 22 adjacent to window frame 8 or elsewhere.

The type of pressurized fluid container 41 shown is of the aerosol type, but the invention is not limited to this type of container.

Figure 6:
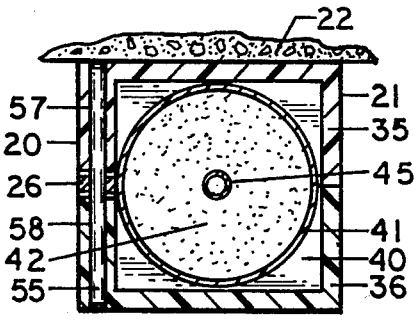
FIG. 6 is a horizontal sectional view taken along line 6—6 of FIG. 3.
Figure 7:
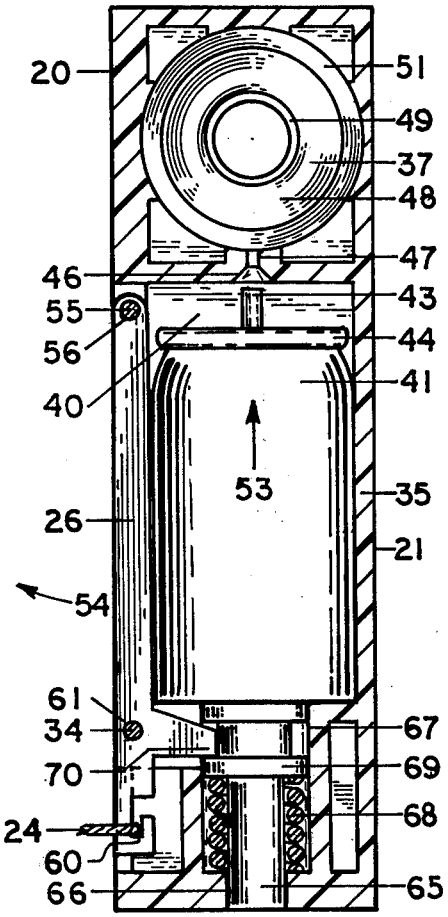
FIG. 7 is a vertical sectional view taken along line 7—7 of FIG. 4.

Now referring to FIGS. 6 through 14 and best seen in FIGS. 6, 7 and 8 the pressurized container cavity 40 is formed when the back and front body halves 35 and 36 are joined together by conventional means such as screws, snap together projections, ultrasonic welding, etc. to form the body member 21. Similarly formed and coaxial with the pressurized container cavity 40 are the actuating member and spring cavity 67 and actuating member bore 66 and the entry section 46 of the passageway 47. The fluid passageway 47 is part of the back body half 35 located in the diaphragm clamping projection 51 of the back body half 35.

The pressurized fluid container 41, hereafter referred to as container 41, is slideably mounted in cavity 40 such that when retained actuating member 69 is released, it moves the container 41 in direction 53 to cause projecting dispensing spout 43 of container 41 to seat into entry section 46, which is coaxial with fluid passageway 47. The material used for dispensing spout 43 is relatively soft and therefore effects an adequate seal with the entry section 46 to retain the fluid pressures normally used in the container 41. The alignment of the entry section 46 with the passageway 47 asures an easy passage for fluid 42 into the fluid expansion cavity 48. The container 41, in the position illustrated in FIGS. 11 and 12, is in its released and discharging position with the dispensing spout 43 depressed by the entry section 46, thereby releasing fluid 42 through passageway 47 into the gas expansion cavity 48 of the back body half 35.

The actuating member 65, in the position illustrated in FIGS. 7 and 8, is in its cocked position where the spring 68, slideably and coaxially mounted around the actuating member 65, is compressed and the container's dispensing spout 43 is coaxial but displaced from the entry section 46. The actuating member 65 is releasably retained in its cocked position by a trigger element 26. The trigger element 26 is shown generally as a flat member includes a shaped latch portion, hereafter referred to a trigger latch 70, holes 56 and 61 and a notch 60 and is best seen in FIGS. 7 and 11. The trigger element 26 is movably mounted on a pin 55 and is slideably contained in the slot 39 and cord opening 59 formed by the front and back body halves 35 and 36. The pin holes 57 and 58 shown in FIG. 6, in body halves 35 and 36. The pin holes 57 and 58 shown in FIG. 6, in body halves 35 and 36 provide location and support for the trigger element's pin 55 upon assembly of the two body halves forming the body member 21. The trigger latch 70 engages the flange 69 of the actuating member 65 when in the cocked position shown in FIG. 7. The spring urged actuating member 65 exerts a force on the trigger element 26 at the trigger latch 70 from the flange 69 which is transmitted to the trigger pin 55 in such a manner that the trigger element 26 will retain the actuating member 65 in its cocked, ready to trigger position.

Figure 10:
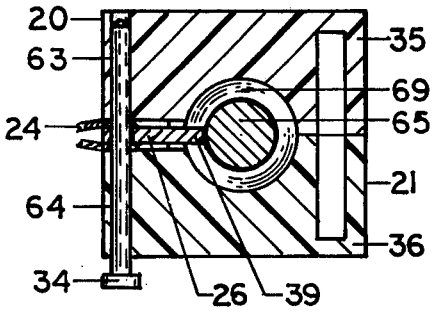
FIG. 10 is a horizontal sectional view taken along line 10—10 of FIG. 3.

The actuating member 65 and trigger element 26 may be locked in their cocked, ready to trigger position as shown in FIG. 7 by means of safety pin 34 which passes through hole 64 in front body half 36, next through hole 61 in trigger element 26 and into hole 63 in back body half 35 as shown in FIG. 10. Holes 64, 61 and 63 are coaxially aligned on assembly and are perpendicular to the plane of travel of the trigger element 26 such that when safety pin 34 is inserted in holes 64, 61 and 63 the trigger element 26 is restrained from moving, thereby safely retaining the actuating member 65 in its cocked position. When the device 20 is mounted on its right side, the safety pin 34 can be entered from either front or back of the device; similarly, if the device 20 is mounted on its front, the safety pin 34 must be entered from the back of the device.

Again referring to FIG. 7, a notch 60, is provided near the end of the trigger element 26 which is opposite of the end containing the trigger pin hole 56. The looped cord 24 is connected at one end to the window sash 23 with fastener 25 and at its other end to the trigger element 26 by being entered in the cord opening 59 and then being looped over the end of the trigger element 26 and into notch 60. The cord 24 is normally detached from the fastener 25 when the device 20 is placed in a non-triggerable condition by safety pin 34. When it is desired to place the device 20 into an area protecting triggerable contition upon the opening of window sash 23; the cord 24 is connected between the fastener 25 and the trigger element 26 of the device 20 as shown in FIG. 1 and the safety pin 34 is removed from the device 20 and hence from trigger element 26. If the window sash 23 is now opened by a burglar or other intruder breaking window lock halves 29 and 30 from mutual engagement as shown in FIGS. 1 and 2; the cord 24 will be pulled in such a manner to rotate the trigger element 26 clockwise in direction 54; moving the trigger latch 70 from engagement with the flange 69 of actuating member 65; permitting said actuating member 65 to be slideably moved by compressed spring 68 in direction 53 in its cavity 67 and bore 66; thereby slideably moving the container 41 in its cavity 40 in direction 53; seating the containers dispensing spout 43 in entry section 26; thereby depressing the spout 43 to cause a valved release of the pressurized fluid 42 through the passageway 47 into the fluid expansion cavity 48. In such a position, as shown in FIGS. 11 and 12, the fluid 42 is discharged from the container 41 into the cavity 28 to operate the sound emitting elements of the device 20, most clearly illustrated in FIGS. 8 and 12 in the non-triggered and triggered conditions, respectively.

After the device 20 has been triggered in the manner described herein above, the expanding fluid in cavity 48 seeks to escape by pushing against the sound emitting diaphragm 32 whose circumferential edge is securely held in the front body half 16 diaphragm clamping cavity 52 by back body half 15 diaphragm clamping projection 51 upon assembly of the two body halves 35 and 36. The diaphragm is pre-tensioned toward the front body half 36 by the conical diaphragm projection 49 of the back body half 35 so as to provide an opposing force to that which is exerted by the expanding fluid 42 in the cavity 48. When the expanded fluid pressure exceeds the diaphragm pressure exerted on projection 49, some fluid 42 escapes into the rear sound cone 37 formed by the projection 49, thereby reducing momentarily the pressure in cavity 48 and allowing diaphragm 32 to seat against projection 49 again. As the pressure builds up again in cavity 48 the process is repeated. The pre-tensioning distance that projection 49 deflects diaphragm 12, the thickness and material of the sound emitting diaphragm 32, the fluid pressure of the container 41 are optimized to produce an oscillation of the diaphragm at a particularly annoying audible frequency. The sound 33 emitted from the sound emitting diaphragm 32 is further mechanically amplified by the front and rear sound cones 38 and 37 and the sound continues until the fluid pressure in the cavity 48 and pressurized fluid container 41 is too low to produce diaphragm oscillations. The back body half 35 has fluid and sound escape ports 50 as part of the construction so that the fluid 42 being valved from the cavity 48 past projection 49 into rear sound cone 37 by the sound emitting diaphragm 32 has a low resistance path to the area ambient, particularly when the device 20 is mounted as shown in FIGS. 1 through 6 and 16. Similarly, the front body half 36 has sound escape ports 50 as part of the construction to supplement the sound 33 emitted by the rear sound cone 37 when the device 20 is mounted by its front surface.

After the device 20 has been triggered to emit sound in the manner described herein above, and when the device body halves 35 and 36 are assembled using screws or snap together projections, not shown, the body halves can be separated to replace the pressurized fluid container 41, after restoring trigger element 26 and actuating member 65 to their cocked position and compression of spring 68 as depicted in FIG. 7. The device 20 shown in the drawings does not show the assembly method for the body halves 35 and 36 to form body member 21 as a number of methods may be employed.

It is an important feature that the trigger element 26 be movable or rotatably mounted, as on pin 55, and that the catch portion 70 thereof present a surface which will slide smoothly on the flange 69 of the actuating member 65 when the trigger element 26 is pulled by cord 24. Yet when the trigger element 26 is positioned in engagement with the flange 69 of the actuating member 65, the trigger element 26 serves to positively retain the actuating member 65 in its cocked position. Hence, substantially less force is required to trigger device 20 of the present invention than would be required if the actuating member 65 were retained in its cocked position by means of a transversely extending trigger pin or the like, yet the actuating member 65 is still safely in its locked position against accidental release by safety pin 34 passing through holes 61, 63 and 64.

Although the device 20 is shown in its preferred embodiment in FIGS. 3 through 12 wherein a trigger element 26 is shaped and movably mounted for mechanical advantage, the trigger element can also be made slideably mounted as described in a subsequent embodiment; such a trigger element requires more force for release of the actuating member.

Yet another important feature is that the spring 68, located in the actuating member and spring cavity 67 be of substantial force so that the actuating member 65 will move the container 41 so that the dispensing spout 43 will seat in the entry section 46 with sufficient force to cause a seal between the two while operating the valve within the top 44 of container 41 to release pressurized fluid 42 through the valve tube 45 shown in FIG. 6, through the dispensing spout 43 and through the passageway into the fluid expansion cavity 48 to oscillate diaphragm 32 alternately from and back to the diaphragm projection 49 thereby causing emission of an alarming sound 33 from the device 20.

The device 20 may be returned to a non-triggerable state if it has not been triggered by reinserting the safety pin 34 through the safety pin holes 64, 61 and 63 and by removing one end of the trigger cord 24 from the fastener 25 on window sash 23 or other triggering means.

It is also important in this embodiment that the discharging means is comprised of a projecting dispensing spout 43 for actuating the valved pressurized container 41, wherein, fluid discharge is caused when the projecting dispensing spout 43 is depressed. The body member 21 contains a fluid passageway 47 having a conical shaped entry section 46 for engaging the projecting dispensing spout 43 and for forming a seal between the conical shaped entry section 46 and the projecting dispensing spout 43, thereby permitting fluid flow through the dispensing spout 43 and the passageway 47 when the pressurized container 41 is moved toward the entry section 46 by the released actuating member 65.

A second embodiment of the invention is illustrated in FIG. 13. In this embodiment the basic structure is as previously described in the first embodiment and like numbers are used to indicate like or corresponding parts.

In this embodiment, the pressurized fluid container 41 shown in FIGS. 7, 8, 11 and 12 having a dispensing spout 43 is replaced with a pressurized fluid container 71 shown in FIG. 13 having a top 74 with a recessed dispensing valve. Pressurized fluid containers of the aerosol type with recessed dispensing valves are well known in the trade usually used in conjunction with spray heads such as found on paint, lubricant, hairspray etc. spraying containers. The triggering means for moving the container 71 in direction 53 is exactly as shown for the first embodiment in FIGS. 7 and 11. In addition, the entry section 46 is replaced with a container valve actuator 76 having a projection 78 extending beyond the entry section toward the top 74 of the pressurized container 71 to engage the recessed valve. The recessed valve is actuated upon depression by projection 78 to emit fluid 42 into the passageway 77 which is coaxially aligned with fluid passageway 47 in back body half 35.

In this embodiment all elements function as described in the first embodiment with the following difference. The container 71 when moved by the actuating member 65 is discharged by the action of projection 78 of the container valve actuator 76 engaging with and depressing the recessed valve of the container 71, the fluid discharging through the fluid passageways 77 and 47 into fluid expansion cavity 48 to produce an alarming sound 33.

A third embodiment of the invention is illustrated in FIG. 14. In this embodiment the basic structure is as previously described in the first embodiment and like numbers are used to indicate like or corresponding parts.

In this embodiment, the pressurized fluid container 41 having a dispensing spout 43 as shown in FIGS. 7, 8, 11 and 12 is replaced with a pressurized fluid container 81, shown in FIG. 14 having a pierceable section 83 of container top 84, such containers being well known in the trade. In addition, the entry section 46 of the fluid passageway 47 of the first embodiment is replaced by a projecting piercing spout 86 having a piercing point 87, an O-ring 88 to effect a pressure seal between the pierceable section 83 and the piercing spout 86, and a fluid passageway 89 which is coaxial with fluid passageway 47 in back body half 35.

In this embodiment, all elements function as described in the first embodiment with the following difference. The container 81 when moved by the actuating member is discharged by the action of the piercing point 87 of the projecting piercing spout 86 piercing the pierceable section 83 until the O-ring seal 88 provides a pressure seal between the pierceable section 83 and the projecting piercing spout 80 to allow fluid 42 to flow through passageways 89 and 47 into fluid expansion cavity 48 to produce an alarming sound 33. This embodiment is best employed in the device by an upside-down position for maximum utilization the fluid 42 contents of container 81.

A fourth embodiment of the invention is illustrated in FIGS. 15 and 16. In this embodiment the basic structure is as previously described but with different triggering means; like numbers are used to indicate like or corresponding parts.

In this embodiment, the trigger element 26 shown in FIGS. 2, 4, 7, 8, 10, 11 and 12 is replaced by trigger element 96 having a shaped portion 97 but not requiring cord notch 60, cord 24 of fastener 25. The latter are replaced on window sash 23 or door frame 93 shown in FIGS. 15 and 16 by a latch plate 95 mounted with screws 98 through latch plate screw holes 99 to door frame 93 or sash 23. The device 90 having body member 91 is mounted on door 92 against the latch plate 95 as shown or other object so that if either the mounted device 90 or the latch plate 95 or other object move away from one another; the device 90 will be triggered to emit an alarming sound 33 when the safety pin 34 has been removed from the device. The trigger element 96 is movably mounted by the passage of trigger pin 55 through trigger pin hole 56 however the trigger pin is now located in holes 63 and 64 of the body member 91 to permit the trigger element 96 to move counter-clockwise in direction 54' when not held in the actuating member 65 retaining position shown in FIG. 16 by either safety pin 34 or the latch plate 95, the safety pin 34 utilizing the former trigger pin holes 57 and 58 of body member 91, the replacement for body member 21. The trigger element 96 shaped latch portion 97 is so designed that when either the latch plate 95 or safety pin 34 no longer holds the trigger element 96 the force exerted by the spring 68 biased actuating members 65 by its flange 69 on the trigger element 96 latch portion 97 causes the trigger element 96 to be rotatably moved about trigger element pin 55 in a counter-clockwise direction 54' thereby allowing the actuating member 65 to move the container to be discharged in the same way as described for the first embodiment to produce an alarming sound 33.

The device 90 is shown in FIG. 15 in another application more suitable to this fourth embodiment. The device 90 is mounted on door 92 which is attached to door frame 93 mounted in wall 22 by hinges 94 and held in place also by door frame 93 mounted in wall 22 by hinges 94 and held in place also by door latch 100 so that the device is located against latch plate 95 mounted on door frame 93 with only sufficient clearance to permit normal operation of the door 92. To render the device triggerable, the safety pin 34 is removed, the trigger element 96 being held by the latch plate 95. A burglar or other intruder upon forcing open door 92 will move the device 90 away from the latch plate 95 thereby releasing the trigger element 96 to rotatably move in direction 54' about trigger pin 55 thereby releasing the actuating member 65 in direction 53 to discharge the pressurized fluid container 41 in the same way described in previous embodiments to emit an alarming sound 33 from the device 90.

If the device 90 has not been triggered, it can be returned to a non-triggerable state by re-inserting the safety pin 34 in holes 58, 61 and 57 of the body member and trigger element.

A fifth embodiment of the invention, which may be combined with any of the first three embodiments in construction, is shown in FIG. 17. In this embodiment the basic structure is as previously described but with different triggering means; like numbers are used to indicate like or corresponding parts.

In this embodiment, the trigger element 26 shown in FIGS. 2, 4, 7, 8, 10, 11 and 12 is replaced by slideable trigger element 106 having a shaped portion 109 but requiring no pin hole 56, or pivot pin 55 but retaining the locking feature by containing safety pin hole 105 for use in conjunction with holes 64 and 63 of the body halves 102 and 103 of body member 101 which have been redesigned to provide slideable but confining surfaces to hold the slideable trigger element in position.

In this embodiment, all elements function as described in the first, second or third embodiments with the following differences. The cord 24 pulls directly on the trigger element 106 in direction 108 to disengage its shaped portion 109 from the flange 69 of actuating member 65 to allow the actuating member 65 to move and in turn move container 41 to the discharging position shown in FIG. 11. The cord 24 is attached to the trigger element 106 through cord hole 105 and the device 110 may be placed in a non-triggerable condition by inserting safety pin 34 in holes 64, 105 and 63 of the trigger element and body halves of body member 101.

A sixth embodiment of the invention, which may be combined with any of the first five embodiments in construction, is shown in FIG. 18. In this embodiment the basic structure and triggering means are as previously described but with different actuating means; like numbers are used to indicate like or corresponding parts.

In this embodiment the actuating member 65 with its flange 69 and actuating spring 68 are replaced by a larger spring 112 in cavity 67; the end coil 113 of the spring 112 becomes the actuating member. The trigger element shaped portion 70, 97 or 109 is also replaced for each respective trigger element 26, 96 or 106 by shaped portion 111 which is designed to releasably retain the spring actuating member 113 which upon release in the ways previously described will move the container 41, 71 or 81 directly for subsequent discharge as previously described to cause the emission of an alarming sound 33. If not triggered, the device can be returned to a non-triggerable state by re-inserting safety pin 34.

Although we have herein shown and described the invention in what we have conceived to be the most practical and preferred embodiments, it is recognized that departure may be made therefrom within the scope of our invention, which is not to be limited to the details disclosed herein, but is to be accorded the full scope of the claims so as to embrace any and all equivalent structures and devices.

We claim:

1. An anti-burglar sound emitting device for use with a pressurized container, the device comprising;

a. a body member mounted on support means;

b. means for slidably supporting said pressurized container in a first chamber in said body member;

c. movable means in a second chamber in said body member for emitting sound by the use of a pressurized fluid, said movable sound emitting means comprising a closure wall for said second chamber;

d. a fluid passageway in said body member for directing a fluid from said pressurized container therethrough to said sound emitting means, said passageway having an entry section between said first and second chambers at one end of said body member;

e. a spring biasing an actuating member and arranged to move said container toward said entry section;

f. means for selectively discharging fluid from said container into said entry section;

g. means for forming a seal around said entry section of said passageway and container to allow flow to be only through said entry section whereby fluid will be discharged exclusively therethrough from said container into said passageway upon movement of said container;

h. means for releasably retaining said biased actuating member whereby said container is displaced from said entry section, said retaining means including a trigger element, said trigger element being mounted for movement between an actuation position and a release position, said trigger element in said actuation position in engagement with said biased actuating member to retain said biased actuating member in a cocked position;

i. a trigger-actuating means associated with said trigger element, said trigger-actuating means arranged to actuate said trigger element upon the application of a physical force to said trigger-actuating means, whereby said trigger element is moved to said release position, thereby causing the release of said biased actuating member from said cocked position whereby said biased actuating member causes movement of said container and thereby causes said discharge means to coact with said entry section of said passageway in allowing discharge of fluid through said passageway to said sound emitting means to produce sound.

2. The anti-burglar sound emitting device of claim 1 in which the pressurized container comprises a pierceable section, means to provide a seal between the pierceable section and said entry section as the container is moved upon release of the biased actuating member, and means for puncturing said pierceable section, whereby fluid may be discharged.

3. The anti-burglar sound emitting device of claim 2 in which said means for puncturing comprises a projecting spout depending from said body member.

4. The anti-burglar sound emitting device of claim 1 wherein said pressurized container includes a dispensing valve actuated to permit fluid discharge therethrough upon depression thereof, said valve being actuated to a fluid release position through movement of said spring biased actuating member acting to move said slidable mounted pressurized container to cause depression of said valve, thus causing discharge.

5. The anti-burglar sound emitting device of claim 4 wherein said valve pressurized container contains a projecting dispensing spout, said dispensing spout discharging fluid upon depression thereof, said entry section being funnel shaped for receiving said projecting spout on said container.

6. The anti-burglar sound emitting device of claim 4 wherein said valve pressurized container includes a recessed valve, said body member includes a projection around said entry section extending beyond said entry section toward said container to engage said recessed valve, said recessed valve actuated upon depression thereof to emit fluid.

7. The anti-burglar sound emitting device of claim 1 wherein the fluid includes a chemical irritant, said chemical irritant being dispersed with the fluid as the device emits sound.

8. The anti-burglar sound emitting device of claim 1 wherein said trigger element is pivotably mounted for movement between said actuation position and said release position.

9. The anti-burglar sound emitting device of claim 1 wherein said trigger element is slidably mounted between said actuation position and said release position.

10. The anti-burglar sound emitting device of claim 1 wherein said trigger element in said actuation position is in shouldered engagement with said biased actuating member to retain said actuating member in a cocked position.

11. The anti-burglar sound emitting device of claim 1 wherein said trigger element in said actuation position is held in said actuation position by an external retaining means; said external retaining means including a latch plate mounted separate from said body member; the body member being movable between a first position in which the external retaining means retains the trigger element in its actuation position, and a second position in which the external retaining means allows the trigger element to move to its release position.

12. An anti-burglar sound emitting device for use with a pressurized container having a projecting dispensing spout, said dispensing spout arranged to discharge fluid upon depression thereof, the device comprising:

a. a body member mounted on support means;

b. means for slidably supporting said pressurized container in a first chamber in said body member;

c. movable means in a second chamber in said body member for emitting sound by the use of a pressurized fluid, said movable sound emitting means comprising a closure wall for said second chamber;

d. a fluid passageway in said body member for directing a fluid from said pressurized container therethrough to said sound emitting means, said passageway having an entry section between said first and second chambers at one end of said body member, said entry section being funnel shaped for receiving said dispensing spout of said container;

e. a spring biasing an actuating member and arranged to move said container toward said entry section;

f. means for releasably retaining said biased actuating member whereby said projecting spout of said container is displaced from said entry section, said retaining means including a trigger element, said trigger element being mounted for movement between an actuation position and a release position, said trigger element in said actuation position in engagement with said biased actuating member to retain said biased actuating member in a cocked position;

g. a trigger-actuating means associated with said trigger element, said trigger-actuating means arranged to actuate said trigger element upon the application of a physical force to said trigger-actuating means whereby said trigger element is moved to said release position, thereby causing the release of said biased actuating member from said cocked position whereby said biased actuating member causes the movement of said container toward said entry section of said passageway wherein said dispensing spout is depressed to allow the discharge of fluid through said passageway to said sound emitting means to produce sound.

13. An anti-burglar sound emitting device for use with pressurized container having a recessed valve, said recessed valve arranged to discharge fluid upon depression thereof, the device comprising:

a. a body member mounted on support means;

b. means for slidably supporting said pressurized container in a first chamber in said body member;

c. movable means in a second chamber in said body member for emitting sound by the use of a pressurized fluid, said movable sound emitting means comprising a closure wall for said second chamber;

d. a fluid passageway in said body member for directing a fluid from said pressurized container therethrough to said sound emitting means, said passageway having an entry section between said first and second chambers at one end of said body member; said body member includes a projection around said entry section extending beyond said entry section toward said container to engage said recessed valve;

e. a spring biasing an actuating member and arranged to move said container toward said entry section;

f. means for releasably retaining said biased actuating member whereby said recessed valve of said container is displaced from said entry section, said retaining means including a trigger element, said trigger element being mounted for movement between an actuation position and a release position, said trigger element in said actuation position in engagement with said biased actuating member to retain said biased actuating member in a cocked position.

g. a trigger-actuating means associated with said trigger element, said trigger-actuating means arranged to actuate said trigger element upon the application of a physical force to said trigger-actuating means whereby said trigger element is moved to said release position, thereby causing the release of said biased actuating member from said cocked position whereby said biased actuating member causes the movement of said container toward said entry section of said passageway wherein said recessed valve is depressed to allow the discharge of fluid through said passageway to said sound emitting means to produce sound.

* * * * *